US009188128B2

(12) United States Patent
Lee et al.

(10) Patent No.: US 9,188,128 B2
(45) Date of Patent: Nov. 17, 2015

(54) ELECTRIC WATER PUMP

(71) Applicants: Hyundai Motor Company, Seoul (KR); Kia Motors Corp., Seoul (KR)

(72) Inventors: Jae Woong Lee, Uiwang-si (KR); Yun Seok Kim, Yongin-si (KR); Hyeong Geun Song, Suwon-si (KR); Byung Soo Kim, Pyeongtaek-si (KR)

(73) Assignees: HYUNDAI MOTOR COMPANY, Seoul (KR); KIA MOTORS CORP., Seoul (KR); AMOTECH CO., LTD., Incheon (KR); MYUNG HWA IND. CO., LTD., Seoul (KR)

( * ) Notice: Subject to any disclaimer, the term of this patent is extended or adjusted under 35 U.S.C. 154(b) by 340 days.

(21) Appl. No.: 13/676,827

(22) Filed: Nov. 14, 2012

(65) Prior Publication Data

US 2013/0136628 A1 May 30, 2013

(30) Foreign Application Priority Data

Nov. 29, 2011 (KR) ..... 10-2011-0125948

(51) Int. Cl.
*F04D 13/06* (2006.01)
*F04D 29/62* (2006.01)

(52) U.S. Cl.
CPC ..... *F04D 13/06* (2013.01); *F04D 13/064* (2013.01); *F04D 29/628* (2013.01)

(58) Field of Classification Search
CPC ..... F04D 13/06; F04D 13/064; F04D 29/628
USPC ..... 417/423.7, 423.8, 423.14, 423.1, 437
See application file for complete search history.

(56) References Cited

U.S. PATENT DOCUMENTS

| | | | | |
|---|---|---|---|---|
| 2,906,208 | A * | 9/1959 | White | 417/357 |
| 2,958,292 | A * | 11/1960 | Lipe et al. | 417/357 |
| 5,692,886 | A * | 12/1997 | Kobayashi et al. | 417/423.12 |
| 6,722,854 | B2 * | 4/2004 | Forsberg | 417/63 |
| 8,450,898 | B2 * | 5/2013 | Sears et al. | 310/194 |
| 8,979,504 | B2 * | 3/2015 | Snider et al. | 417/53 |
| 2004/0037719 | A1 * | 2/2004 | Sunaga et al. | 417/423.8 |
| 2005/0214135 | A1 * | 9/2005 | Shibuya et al. | 417/357 |
| 2007/0286753 | A1 * | 12/2007 | Ihle et al. | 417/423.7 |

FOREIGN PATENT DOCUMENTS

| | | | |
|---|---|---|---|
| JP | 2007315265 | A | 12/2007 |
| JP | 2008109848 | A | 5/2008 |
| KR | 1020050000245 | A | 1/2005 |
| KR | 1020440018254 | A | 2/2011 |
| KR | 10-2011-0055280 | A | 5/2011 |
| KR | 1020110055279 | A | 5/2011 |
| KR | 1020110055280 | A | 5/2011 |
| KR | 1020110055289 | A | 5/2011 |
| KR | 1020110055297 | A | 5/2011 |
| KR | 10-1141946 | B1 | 5/2012 |
| WO | WO 96/31936 | | 10/1996 |

* cited by examiner

*Primary Examiner* — Charles Freay
*Assistant Examiner* — Lilya Pekarskaya
(74) *Attorney, Agent, or Firm* — Morgan, Lewis & Bockius LLP

(57) ABSTRACT

An electric water pump, which can not only ensure more reliable waterproof and cooling performance, provides enhanced durability and operational reliability, and is able to reduce the number of parts and has a more compact structure, compared to the conventional technique.

11 Claims, 5 Drawing Sheets

ELECTRIC WATER PUMP

CROSS-REFERENCES TO RELATED APPLICATIONS

The present application claims priority of Korean Patent Application Number 10-2011-0125948 filed Nov. 29, 2011, the entire contents of which application is incorporated herein for all purposes by this reference.

BACKGROUND OF INVENTION

1. Field of Invention

The present invention relates generally to electric water pumps and, more particularly, to a structure of an electric water pump which is provided to circulate a coolant for an engine of a vehicle.

2. Description of Related Art

As is well known to those skilled in the art, a water pump for an engine is provided to circulate a coolant used to cool the engine. The use of electric water pumps, which operate independently of an engine and are able to optimize the flow rate of a coolant, has recently increased thus improving the fuel efficiency of the engine.

Such an electric water pump is basically provided with a motor and electronic devices which are powered by electricity. Therefore, reliable waterproof and cooling performance must be ensured. In addition, the durability and operational reliability must be sufficiently high. Further, the electric water pump is preferably configured to be compact.

An exemplar of the prior art is Korean Patent Application No. 10-2011-0055279 A.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for an electric water pump which not only can ensure more reliable waterproof and cooling performance but can also provide enhanced durability and operational reliability, and which is able to reduce the number of parts and has a more compact structure, compared to the conventional technique.

Various aspects of the present invention provide for an electric water pump, including a rotating shaft, a rotor assembly fitted over a circumferential outer surface of the rotating shaft, the rotor assembly being rotatably installed in a space through which a pumped coolant is able to flow, a stator assembly enclosing the rotor assembly and providing magnetic force for rotating the rotor assembly using electricity supplied from an outside, and a sealing can forming an inner surface of the stator assembly such that a gap is defined between the inner surface of the stator assembly and a circumferential outer surface of the rotor assembly, the sealing can enclosing and rotatably supporting both a rear end of the rotor assembly and a rear end of the rotating shaft.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
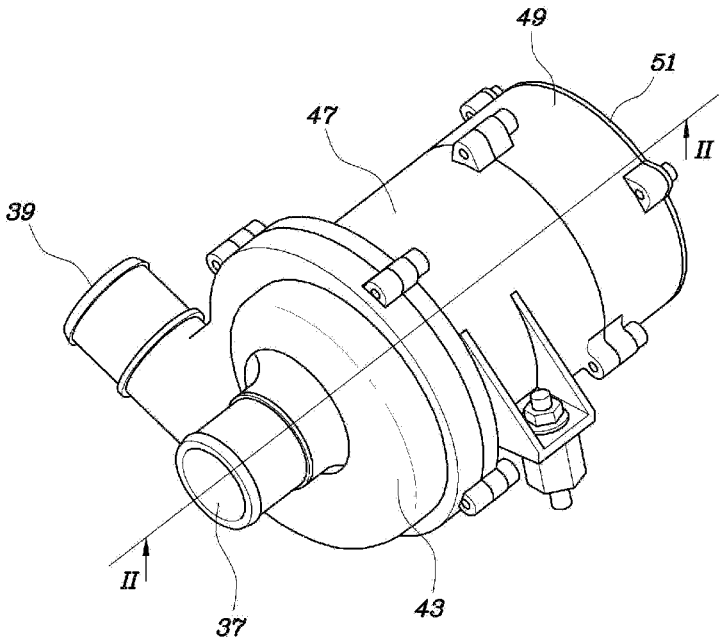
FIG. 1 is a perspective view showing the outer shape of an exemplary electric water pump according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIGS. 1 through 5, an electric water pump according to various embodiments of the present invention includes a rotating shaft 1, a rotor assembly 3, a stator assembly 5 and a sealing can 7. The rotor assembly 3 is fitted over a circumferential outer surface of the rotating shaft 1 and is rotatably installed in a space through which the pumped coolant can flow. The stator assembly 5 encloses the rotor assembly 3 and provides magnetic force for rotating the rotor assembly 3 using electricity supplied from the outside. The sealing can 7 forms an inner surface of the stator assembly 5 such that a gap G is defined between it and a circumferential outer surface of the rotor assembly 3. The sealing can 7 completely encloses rear ends of the rotor assembly 3 and the rotating shaft 1 and rotatably supports the rear ends.

In detail, the sealing can 7 forms a portion of the stator assembly 5 and is a housing that has a shape which can enclose and support the rear ends of the rotor assembly 3 and the rotating shaft 1 of the rotor assembly 3. The sealing can 7 provides a waterproofing function which can prevent the coolant that flows through the inner space of the sealing can 7 in which the rotor assembly 3 is disposed from leaking outside the sealing can 7.

An impeller 9 is provided on a front end of the rotating shaft 1 to pump the coolant. The sealing can 7 is configured such that the front end thereof is open towards the front end of the rotating shaft 1 to which the impeller 9 is mounted, while the rear end thereof is closed to cover the rear end of the rotating shaft 1 that is opposed to the impeller 9.

A rear bearing 11 is coupled to the rear end of the rotating shaft 1. A support rib 13 which supports the rear bearing 11 protrudes inwards from the sealing can 7. In detail, the support rib 13 protrudes from an inner surface of the rear end of the sealing can 7 and forms a stepped portion. A coolant passage 15 along which the coolant can flow is formed between the rear bearing 11 and the rear end of the rotating shaft 1.

The rear end of the rotating shaft 1 is rotatably supported by the rear bearing 11 that is supported by the support rib 13 in the sealing can 7. The coolant can flow around the rear bearing 11 and the rear end of the rotating shaft 1 through the coolant passage 15, so that not only can the coolant cool these portions but the shock absorption function of the coolant can prevent the rotational vibrations caused by the rotating shaft 1 from damaging support parts such as the support rib 13. In addition, this coolant provides the effect of cooling a driver 19 that is provided in a driver installation space 17 which will be explained later.

The stator assembly 5 includes a plurality of insulators 21 which are disposed outside the sealing can 7, a coil 23 which is wound around the insulator 21, and a stator core 25 which supports the insulators 21. The stator assembly 5 further includes a BMC (Bulk Mold Compound) case 27 which is integrally and/or monolithically formed with the sealing can 7, the insulators 21, the coil 23 and the stator core 25 by extruding under high pressure after the insulator 21, the coil 23 and the stator core 25 have been fixed on the outer surface of the sealing can 7.

The sealing can 7 is formed by injection-molding PPS (Polyphenylene sulfide) which is a kind of engineering plastic.

In other words, the stator assembly 5 is formed by a double injection molding process in which the sealing can 7 is primarily formed by injection molding, the insulators 21, the coil 23 and the stator core 25 are fixed on the outer surface of the sealing can 7, and then it is integrally and/or monolithically injection-molded using BMC which is a potassium based compound material and a low shrinkage material.

As such, if the stator assembly 5 is formed by the double injection molding process, the air layer which may result from a combination of different materials and components can be prevented from being formed in the stator assembly 5. This prevents a drop in the efficiency of the motor from occurring, thus enhancing the performance of the motor. In addition, this helps to maintain the uniformity of the performance of the motor.

Furthermore, the BMC material has superior heat dissipation characteristics. Ultimately, the specific shape of the sealing can 7, the superior moisture-proof and waterproof function of the PPS material, and the superior heat dissipation characteristics of the BMC case 27 can markedly enhance the operational reliability of the electric water pump.

A hole sensor board 29 which may be provided with a hole sensor to sense rotation of the rotor assembly 3 is integrally installed in the BMC case 27.

A stop protrusion 31 protrudes outwards in the radial direction from the front end of the sealing can 7. The stop protrusion 31 is inserted into the BMC case 27, thus enhancing the coupling force between the sealing can 7 and the BMC case 27. A sealing coupling end 35 protrudes forwards from the stop protrusion 31 so that a circumferential inner surface thereof compresses the sealing member 33 and supports it, thus sealing and isolating the inside of the sealing can 7 from the outside.

As such, the sealing can 7 can be more tightly and strongly coupled to the BMC case 27 by the stop protrusion 31.

Figure 2:
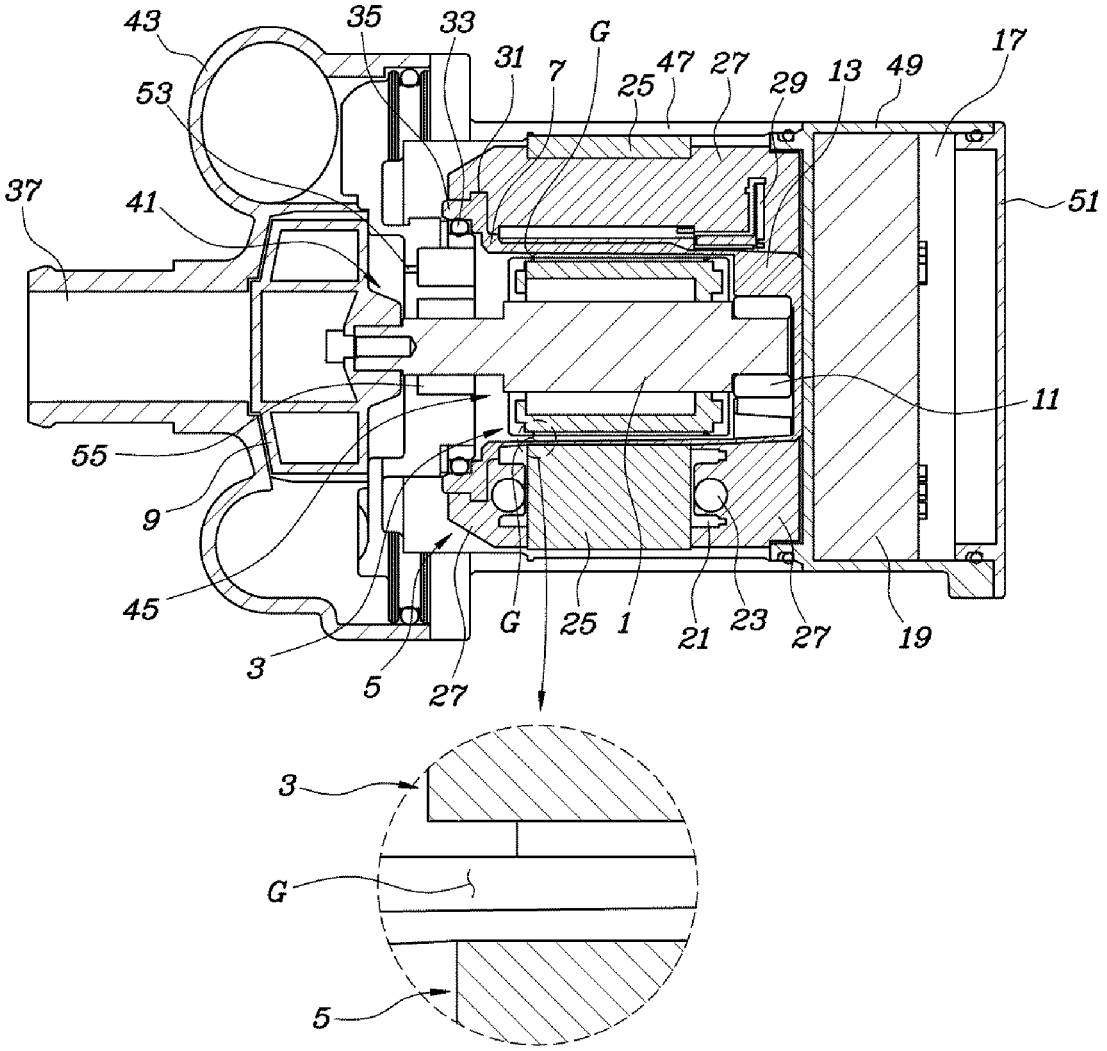
FIG. 2 is a sectional view taken along line II-II of FIG. 1.
Figure 3:
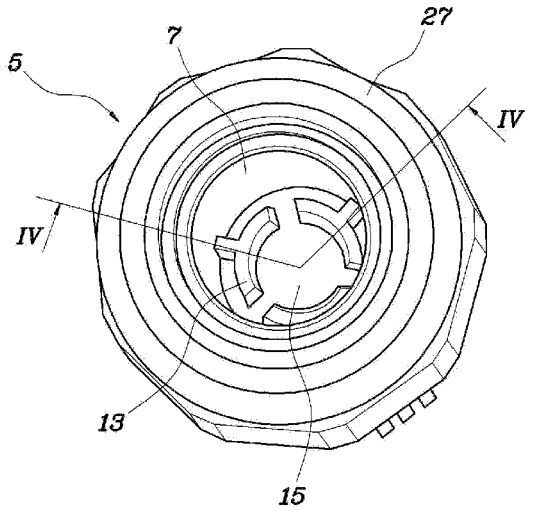
FIG. 3 is a perspective view illustrating a stator assembly of the electric water pump of FIG. 1.
Figure 4:
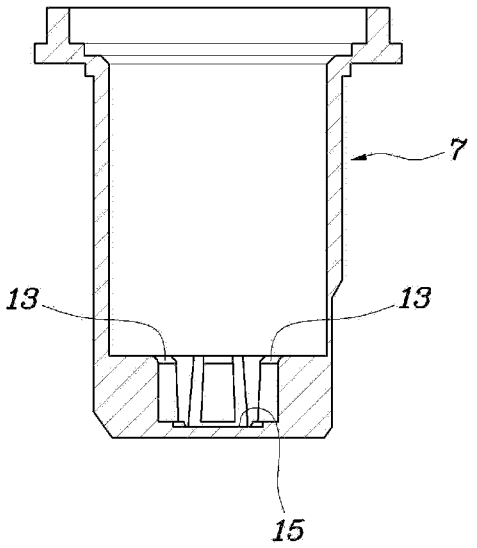
FIG. 4 is a sectional view taken along line IV-IV of FIG. 3.
Figure 5:
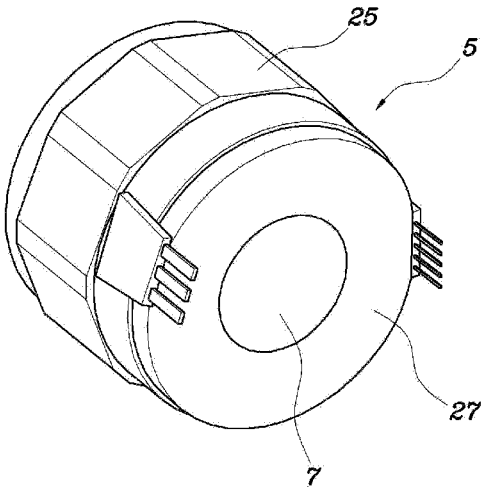
FIG. 5 is a perspective view showing the opposite side of FIG. 3.

Referring to FIG. 2, the electric water pump further includes a pump cover 43, a body cover 47, a driver case 49 and a driver cover 51. The pump cover 43 has an inlet 37 through which the coolant is drawn, an outlet 39 through which the coolant is discharged, and a pumping space 41 in which the impeller 9 rotates. The body cover 47 is coupled to the pump cover 43 and defines the pumping space 41 along with the pump cover 43. The body cover 47 defines, separately from the pumping space 41, a motor space 45 in which the stator assembly 5 and the rotor assembly 3 that constitute the motor are installed. The driver case 49 is coupled to the body cover 47 and defines the motor space 45 along with the body cover 47. The driver case 49 defines, separately from the motor space 45, the driver installation space 17 in which the driver 19 that controls the motor is installed. The driver cover 51 seals the driver case 49.

Compared to the technique of the prior art document, the above-mentioned structure of the present invention does not require a sealing member which has been provided around the rear end of the rotating shaft 1 between the driver cover 51 and the stator assembly 5 in the prior art to prevent the coolant in the space that receives the rotor assembly 3 from leaking. Therefore, this structure can reduce the number of parts. Moreover, the waterproof performance resulting from the sealing can 7 which has the improved shape is fundamentally superior and more reliable than the waterproof performance caused by the sealing member.

Furthermore, the sealing member 33 is interposed between the sealing coupling end 35 of the sealing can 7 and the body cover 47 so that the inside of the sealing can 7 is sealed and isolated from the outside. A communication hole 53 is formed in the body cover 47 and disposed radially inward of the sealing member 33. The communication hole 53 forms a passage through which the pumping space 41 can communicate with the space in which the rotor assembly 3 is disposed. A front bearing 55 which rotatably supports the front end of the rotating shaft 1 is provided in the body cover 47 and disposed radially inward of the communication hole 53.

As such, the rotating shaft 1 is rotatably provided in such a way that the front end thereof is supported by the front bearing 55 on the body cover 47 while the rear end thereof is supported by the rear bearing 11 on the sealing can 7. Some of the coolant pumped from the pumping space 41 flows into the sealing can 7 through the communication hole 53. The sealing member 33 prevents this coolant from leaking out of the sealing can 7.

The driver case 49 is installed such that a front wall thereof is put into close contact with a rear surface of the sealing can 7. The driver 19 is brought into close contact with the front wall of the driver case 49.

Therefore, heat generated from the driver 19 can be effectively dissipated by the coolant that flows around the rear end of the sealing can 7.

Figure 6:
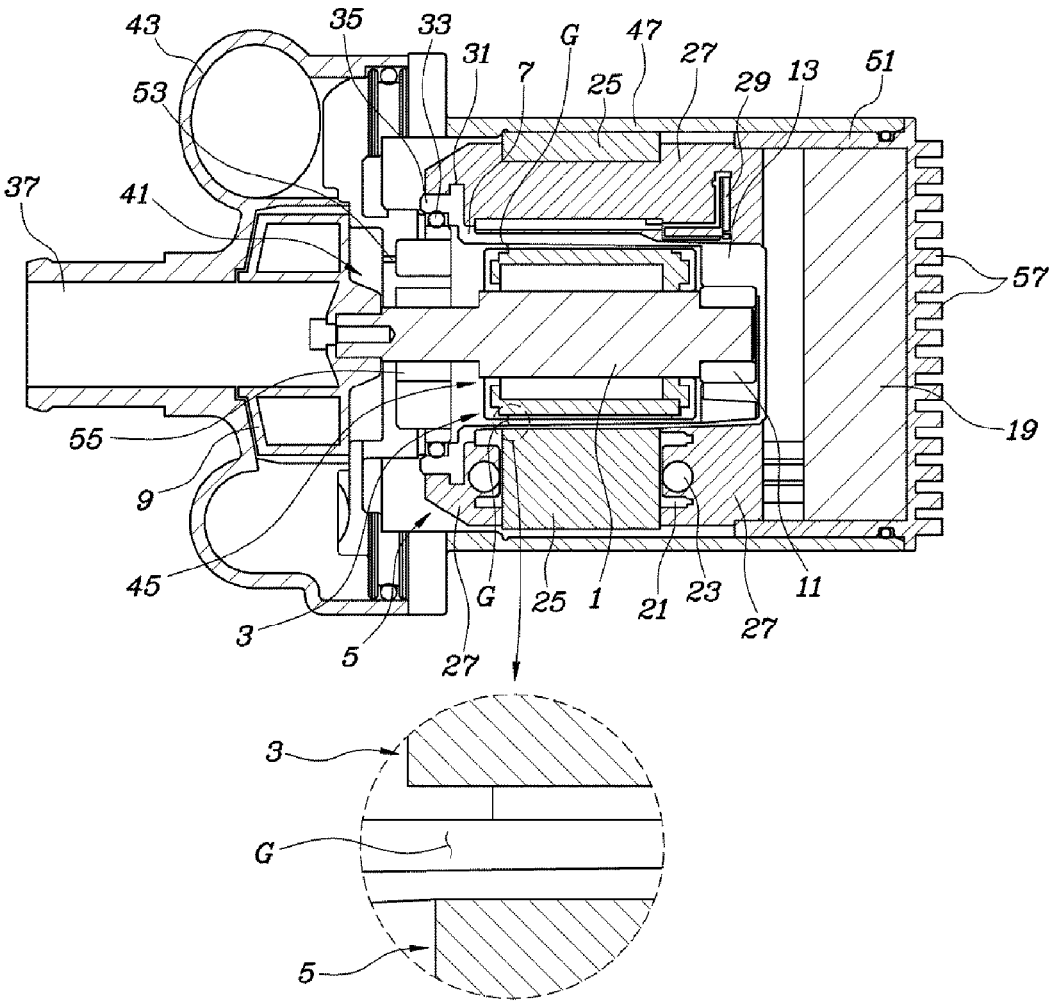
FIG. 6 is a sectional view illustrating an exemplary electric water pump according to the present invention.

As shown in FIG. 6, the general construction of various embodiments is the same as that described above, but the body cover 47 is coupled to the pump cover 43 and defines the pumping space 41 along with the pump cover 43, and the body cover 47 defines, separately from the pumping space 41, the motor space in which the stator assembly 5 and the rotor assembly 3 that constitute the motor are installed, and also defines the driver installation space in which the driver 19 that controls the motor is installed. Furthermore, the driver cover 51 is coupled to the body cover 47 such that the body cover 47 is closed by making direct contact with the driver cover 51. In addition, heat dissipation fins 57 protrude rearwards from an outer surface of a rear end of the driver cover 51 and dissipate heat generated from the driver 19.

In other words, unlike that described above, the stator assembly 5 and the driver 19 use the same space so that the driver case, O-rings between it and other parts, and coupling bolts, etc. are omitted, thus reducing the number of parts, the number of manufacturing processes, the weight of the product, and the production cost.

A front end of the driver cover 51 is inserted into the body cover 47 and functions to fix the stator assembly 5 at the correct position. Particularly, the driver 19 is disposed such that it is put into close contact with the rear end of the driver cover 51 on which the heat dissipation fin 57 are provided, so that the driver 19 can be effectively cooled by the driver cover 51.

As described above, in an electric water pump according to the present invention, a sealing can not only provides more reliable waterproof and cooling performance but also enhances the durability and operational reliability of the electric water pump. Furthermore, the present invention reduces the number of parts and has a more compact structure, compared to the conventional technique.

For convenience in explanation and accurate definition in the appended claims, the terms front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electric water pump, comprising:

a motor having:

a rotating shaft;

a rotor assembly fitted over a circumferential outer surface of the rotating shaft, the rotor assembly rotatably installed in a space through which a pumped coolant flows;

a stator assembly enclosing the rotor assembly and providing magnetic force for rotating the rotor assembly using electricity; and a sealing can forming an inner surface of the stator assembly such that a gap is defined between the inner surface of the stator assembly and a circumferential outer surface of the rotor assembly, the sealing can enclosing and rotatably supporting both a rear end of the rotor assembly and a rear end of the rotating shaft;

a pump cover having an inlet through which the coolant is drawn thereinto, an outlet through which the coolant is discharged therefrom, and a pumping space in which an impeller rotates; and a body cover coupled to the pump cover and defining the pumping space along with the pump cover, the body cover defining, separately from the pumping space, a motor space receiving therein the stator assembly and the rotor assembly of the motor, wherein a sealing coupling end is provided on a front end of the sealing can, and a sealing member is interposed between the sealing coupling end and the body cover so that an inside of the sealing can is sealed and isolated from the outside, a communication hole is formed in the body cover and disposed radially inward of the sealing member, the communication hole communicating the pumping space with the space in which the rotor assembly is installed, and a front bearing is provided in the body cover and disposed radially inward of the communication hole, the front bearing rotatably supporting the front end of the rotating shaft.

2. The electric water pump as set forth in claim 1, wherein the impeller is provided on a front end of the rotating shaft to pump the coolant, and the sealing can is configured such that the front end thereof is open towards the front end of the rotating shaft on which the impeller is provided, while a rear end thereof is closed to cover the rear end of the rotating shaft that is opposed to the impeller.

3. The electric water pump as set forth in claim 1, wherein a rear bearing is coupled to the rear end of the rotating shaft, a support rib protrudes inwards from the sealing can, the support rib supporting the rear bearing, wherein the support rib protrudes from an inner surface of a rear end of the sealing can and forms a stepped portion whereby a coolant passage is formed between the rear bearing and the rear end of the rotating shaft so that the coolant flows along the coolant passage.

4. The electric water pump as set forth in claim 1, wherein the stator assembly comprises:

a plurality of insulators disposed outside the sealing can;

a coil wound around the insulator;

a stator core supporting the insulators;

a Bulk Mold Compound (BMC) case integrally formed with the sealing can, the insulators, the coil and the stator core by extruding under high pressure after the insulator, the coil and the stator core have been fixed on an outer surface of the sealing can.

5. The electric water pump as set forth in claim 4, wherein a hole sensor board is integrally installed in the BMC case, the hole sensor board provided with a hole sensor to sense rotation of the rotor assembly.

6. The electric water pump as set forth in claim 4, wherein the sealing can is formed by injection-molding Polyphenylene sulfide (PPS).

7. The electric water pump as set forth in claim 4, wherein a stop protrusion protrudes outwards in a radial direction from a front end of the sealing can, the stop protrusion inserted into the BMC case, thus enhancing coupling force, and the sealing coupling end protrudes forwards from the stop protrusion so that a circumferential inner surface thereof compresses and supports the sealing member, thus sealing and isolating an inside of the sealing can from the outside.

8. The electric water pump as set forth in claim 1, further comprising:

a driver case coupled to the body cover and defining the motor space along with the body cover, the driver case defining, separately from the motor space, a driver installation space receiving therein a driver controlling the motor; and a driver cover sealing the driver case.

9. The electric water pump as set forth in claim 8, wherein a front wall of the driver case is brought into close contact with a rear surface of the sealing can, and the driver is brought into close contact with the front wall of the driver case.

10. The electric water pump as set forth in claim 1, wherein the body cover defines, separately from the pumping space, both the motor space and a driver installation space receiving therein a driver controlling the motor; and a driver cover coupled to the body cover to seal a rear end of the body cover, with a plurality of heat dissipation fins protruding rearwards from an outer surface of a rear end of the driver cover, the heat dissipation fins dissipating heat generated from the driver.

11. The electric water pump as set forth in claim 10, wherein a front end of the driver cover is disposed in the body cover and fixes the stator assembly, and the driver is brought into close contact with the rear end of the driver cover on which the heat dissipation fins are provided.

* * * * *